United States Patent [19]

Sipiano

[11] Patent Number: 4,546,841

[45] Date of Patent: Oct. 15, 1985

[54] MOTOR ROLLER-SKATE

[76] Inventor: Michele Sipiano, Via Costantino, 22, 90147 Palermo, Italy

[21] Appl. No.: 535,623

[22] Filed: Sep. 26, 1983

[51] Int. Cl.[4] ..... B60K 17/04

[52] U.S. Cl. ..... 180/181; 403/1; 403/348

[58] Field of Search ..... 192/114 T; 403/1, 348, 403/349; 180/180, 181

[56] References Cited

U.S. PATENT DOCUMENTS

| | | | |
|---|---|---|---|
| 710,240 | 9/1902 | Belfield et al. | 403/348 X |
| 2,625,229 | 1/1953 | Voorhees | 180/181 |
| 2,857,008 | 10/1958 | Pirrello | 180/181 |
| 3,964,560 | 6/1976 | Husted | 180/181 |
| 4,385,577 | 5/1983 | Graham | 403/348 X |

FOREIGN PATENT DOCUMENTS

| | | | |
|---|---|---|---|
| 23354 | 1/1956 | Fed. Rep. of Germany | 403/348 |

*Primary Examiner*—Joseph F. Peters, Jr.
*Assistant Examiner*—Michael Mar
*Attorney, Agent, or Firm*—Cushman, Darby & Cushman

[57] ABSTRACT

A motor system is releasably connected to a roller-skate provided with a driving shaft. The motor system comprises a power unit mounted on a frame which can be tied as a kit-bag to a roller-skate body and a flexible connection for transmitting the movement from the power unit to the driving shaft. A releasable clutch is interposed between the flexible connection of the motor system and the driving shaft of the roller skate.

2 Claims, 7 Drawing Figures

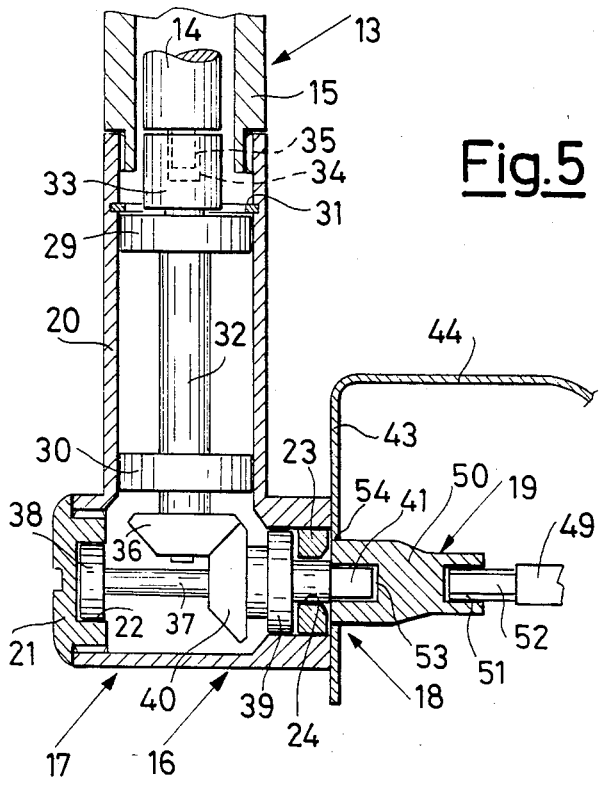
Fig.5
Fig. 6
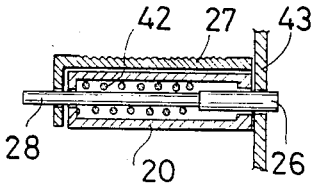
Fig.7
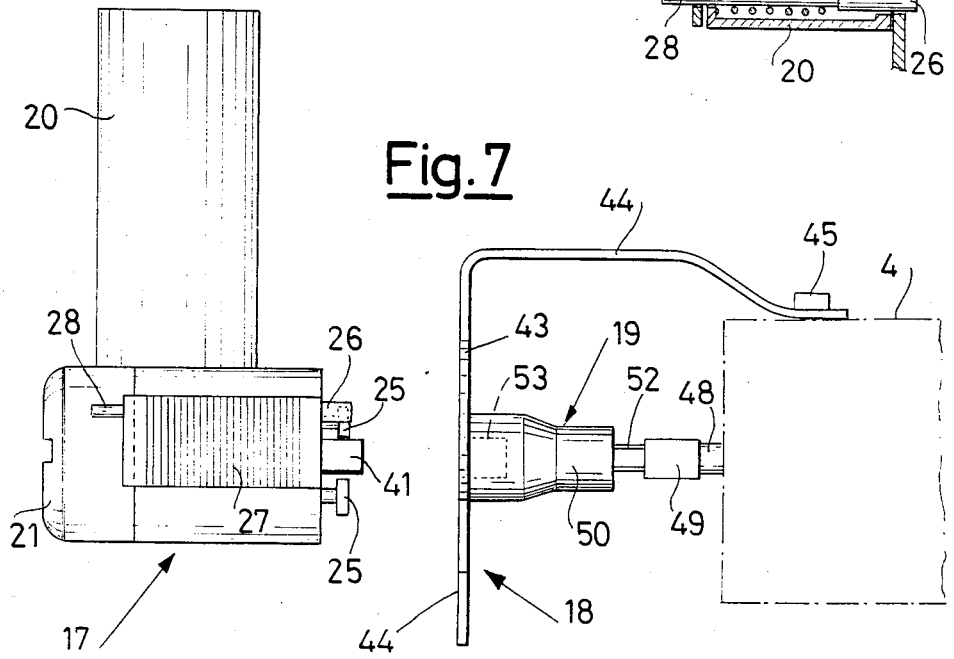

MOTOR ROLLER-SKATE

The present invention relates to a motor roller-skate, which can be used both for simple enjoyment and for sporting purposes and is also quickly changeable to a normal non-motorized skate.

The skate according to the invention is characterized in that it comprises a roller-skate provided with a driving shaft, a motor system including a power unit mounted on a frame which can be tied as a kit-bag to the body of the roller-skater and a flexible connection for the transmission of the movement from said power unit to said driving shaft, and a releasable clutch interposed between said flexible connection and said driving shaft.

It is evident that with the motor skate according to the invention a good roller-skater can enjoy himself by going through long distances, perhaps with climbing lengths, without any effort; naturally, the same thing can be made for athletic purposes.

On the other hand, if and when the roller-skater wants to come back to the normal skating way, it is simple for him to do so by releasing the releasable clutch and by putting away the motor system in a suitable place.

An embodiment of the skate according to the invention is illustrated for better clarity in the enclosed drawings, in which:

FIG. 5 shows the group of FIG. 2 in axial section along a plane passing through lines V—V of FIGS. 3 and 4;

FIG. 6 shows a detail of the above mentioned group in section along line VI—VI of FIG. 2;

FIG. 7 shows the group of FIG. 2 in release condition.

Figure 1:
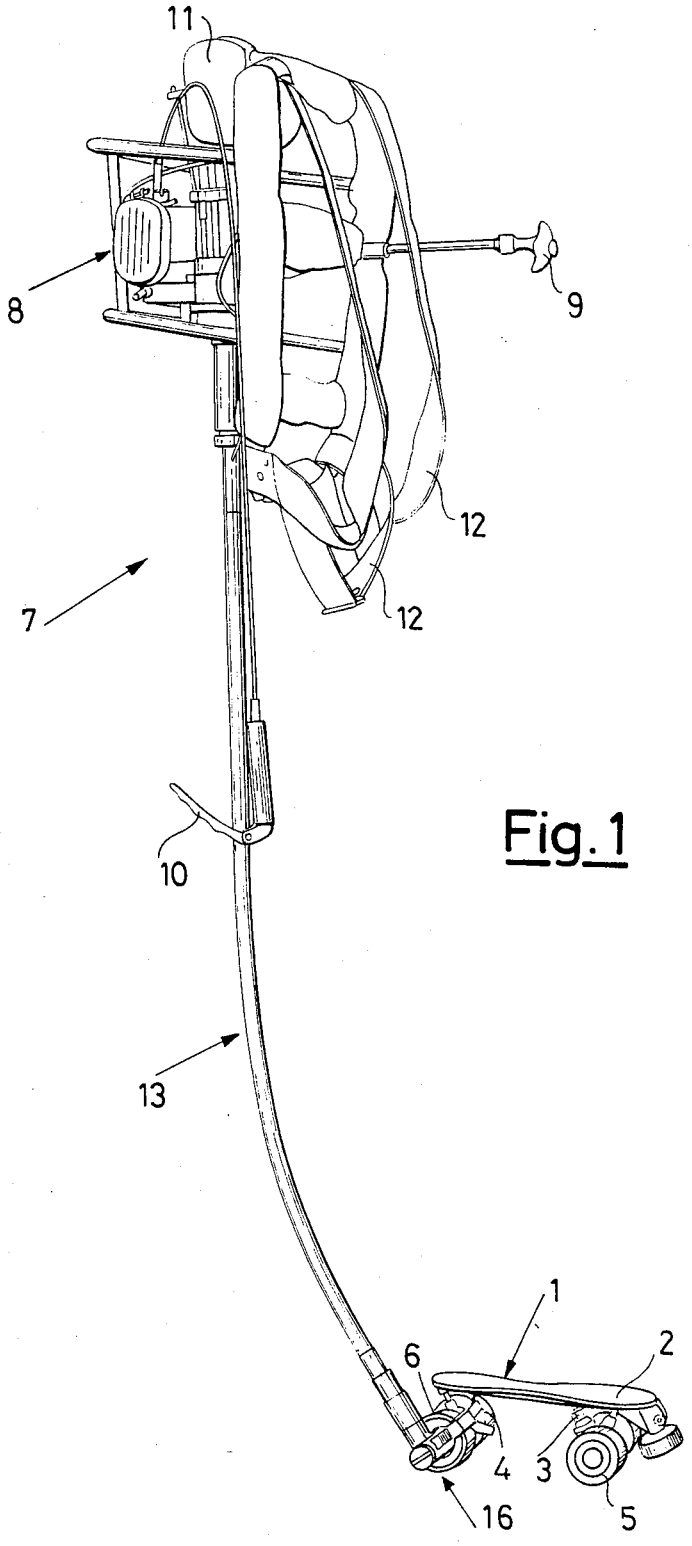
FIG. 1 shows in perspective view the assembly of a motor skate according to the invention.

With reference to the general view of FIG. 1, it is shown that to a roller-skate 1 of conventional kind, that is with a plane 2 for the foot support, wheel supports 3 and 4, and pairs of wheel 5 and 6, but with the rear wheels 6 mounted and linked on a driving shaft rotatably supported by the rear support 4 (as it will be better explained later on), there is associated a motor system 7 including a power unit 8 of the two-skate explosion engine kind with a starting handle 9 and an accelerating lever 10, a stuffed rigid frame 11 which supports through shock-absorbers the power unit 8 and can be tied as a kit-bag to the skater body by means of belts 12 and a flexible connection 13 (constituted by a rotating inner shaft 14 and by an outer sheath 15 as shown in FIG. 5) for the transmission of the movement from the motor unit 8 to the driving shaft of the skate 1. The above mentioned motor system 7 is releasably linked to the skate by means of a releasable clutch 16, whose features will be made evident by the following description, made with reference to FIGS. 2–7.

As shown in the above mentioned Figures, the releasable clutch 16 is basically composed by two separable parts 17 and and 18, of which the first one is linked to the flexible connection 13 of the motor system 7 and the second one is linked to the support 4 and to the driving shaft of the skate 1.

Figure 3:
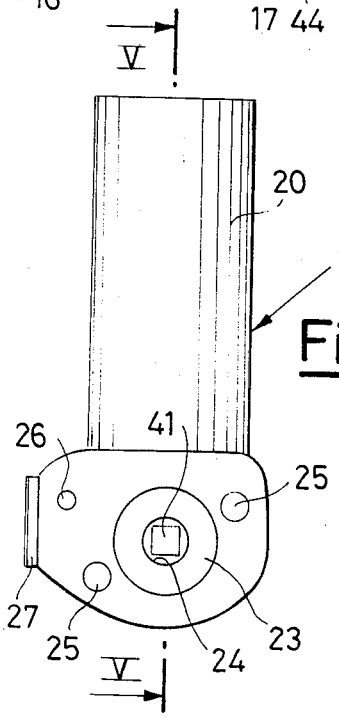
FIG. 3 shows one of the two separable parts of the above mentioned clutch, as it can be seen from right with respect to FIG. 2.

The part 17 comprises a L-shaped hollow sleeve 20, whose long branch is screwed on the end of the outer sheath 15 of the flexible connection 13 and whose short branch is closed at one end by a screw plug 21 provided with a cylindric cavity 22, while at the other end it includes a bush 23 passed through by an axial cylindric hole 24. As shown in FIGS. 3 and 7, from the above mentioned other end of the short branch of the sleeve 20 there axially extend two fixed pins with enlarged head 25, as well as an axially movable pin 26, which a spring 42 normally stresses outwards and can temporarily be withdrawn inside the sleeve 20 under the control of a knurled sliding plate 27 screwed on a threaded extension 28 of the pin 26 (FIG. 6).

Inside the long branch of the sleeve 20 (FIG. 5) there is rotatably housed with the aid of bearings 29 and 30 and of a retaining ring 31 a main shaft 32, which at one end includes a cylindrical head 33 provided with a square seat 34 in which there is engaged a square nib 35 arranged as an extension of the inner shaft 14 of the flexible connection 13 and at the other end includes a conic gear 36.

Inside the short branch of the sleeve 20 there is rotatably housed, in its turn, a secondary shaft 37, which is supported by two bearings 38 and 39, the first one of which is housed in the cylindric cavity of the plug 21. On said secondary shaft there is keyed a conic gear 40 in engagement with the conic gear 36 of the main shaft 32 (FIG. 5). One end (of cylindrical shape) of the secondary shaft 37 passes through the axial hole 24 of the bush 23 and ends outside the sleeve 20 with a square extension 41.

Figure 2:
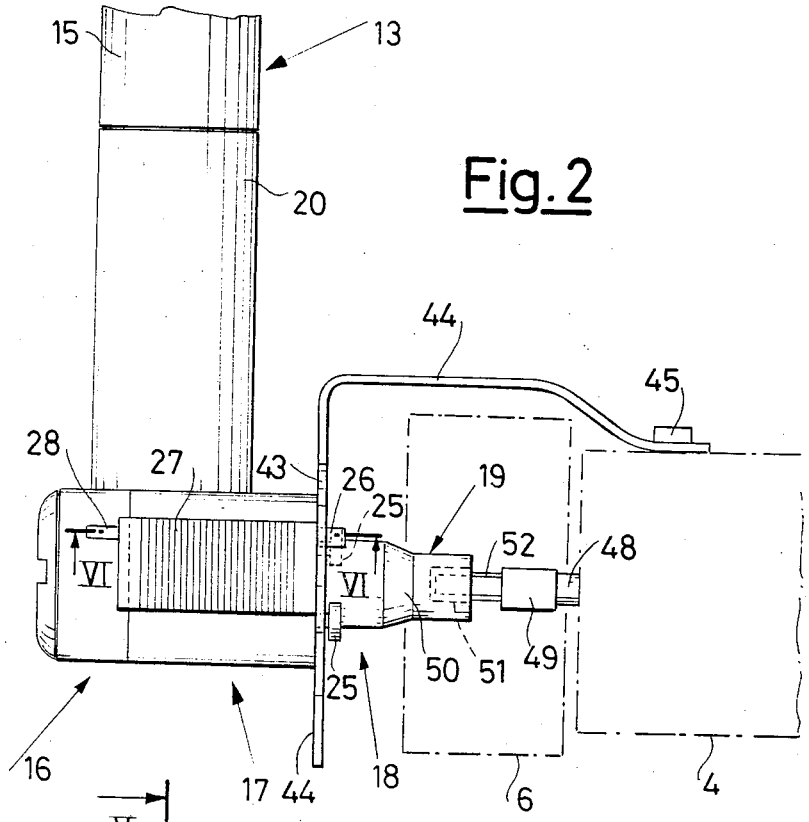
FIG. 2 shows the detail in enlarged scale, in engaged condition, of the group which forms the releasable clutch between the flexible connection for movement transmission and the driving shaft of the roller skate.
Figure 4:
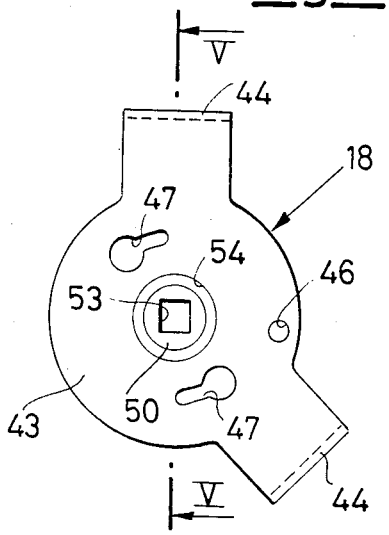
FIG. 4 shows the other one of said separable parts, as it can seen from left with respect to FIG. 2.

The part 18 of the releasable clutch 16 includes in its turn a flat bracket 43, which is positioned in front of the end of the sleeve 20 from which the square extension 41 of the shaft 37 goes out and is made integral with the wheel support 4 of the skate 1 by means of arms 44 fixed by screws 45 (FIG. 2). As shown in FIG. 4, the bracket 43 includes a hole 46 suitable for the insertion of the pin 26 of the part 17 and elongated eyelets with enlarged head 47 for the insertion and the bayonet-blocking of the enlarged-head pins 25 of the same part 17. The position of the hole 46 is chosen so that the pin 26 can enter only when the pins 25, after having passed through the enlarged head of the eyelets 47, are moved by rotation of the part 17, in blocking engagement with the narrow opposite end of the same eyelets 47. The bracket 43 also includes a central hole 54, through which the driven end of the driving shaft 19 can pass to connect with the secondary shaft 37 and therefore with the power unit 8.

As shown in FIGS. 2, 5 and 7, the driving shaft 19 is really constituted by a cylindric shaft 48 rotatably supported (by means of not shown bearings) by the support 4, by a pair of square segments 49 (one for each part) for the solidarization of the rear wheels 6, and by a connection element of spread shape 50, which at the narrower end includes a threaded seat 51 in which a threaded extension 52 of the shaft 48 is screwed and at the wider end (rotatably housed in the central hole 54 of the bracket 43) includes on the contrary a square seat 53 in which the square extension 41 of the shaft 37 of the part 17 is engaged.

From the described structure derives the following way of working of the skate illustrated in the drawings. The clutch 16 is operating, that is the two parts 17 and 18 are linked to each other and the extension 41 of the shaft 37 is inserted in the seat 53 of the connection element 50 of the driving shaft 19, that is finally the motor system 7 is structurally and functionally connected to the skate 1, when the enlarged heads of the pins 25, once passed through the enlarged ends of the eyelets 47 of the bracket 43, have reached by rotation the blocking engagement with the narrow ends of the same eyelets and the pin 26 has consequently jumped inside the hole 46 of the bracket 43, thus constituting a safety against any unwanted release. In such a condition the power unit 8, suitably operated by the roller-skater, rotates the driving shaft 19 and with it the rear wheels 6 of the skate 1, finally making motorized the same skate.

On the other hand it is possible to release the clutch 16 in order to separate the skate from the motor system and therefore to allow the traditional use of the same state. This may be accomplished by moving the sliding plate 27 so as to cause the pin 26 to withdraw from the hole 46 of the bracket 43, and then by rotating the part 17 until the pins 25 disengage from the eyelets 47 of the same bracket 43. The two parts 17 and 18 of the clutch 16 are thus separated and the skate 1 is in its turn separated from the motor system 7.

I claim:

1. A motorized roller-skate comprising a pair of drive wheels mounted on a rotatable drive shaft, a motor system including a power unit mounted on a frame which can be tied as a kit-bag to the body of the roller-skater and a flexible connection comprising a rotatable flexible shaft within an outer housing for driving the drive shaft, the flexible connection being connected to an L-shaped housing, the L-shaped housing containing a conical gear transmission having a rotatable driving element disposed at a right angle to the flexible shaft and capable of releasably engaging the drive shaft, the L-shaped housing having a releasable connection for connecting to the side of the roller skate, the releasable connection including a first bracket on the L-shaped housing having a plurality of connection pins with enlarged heads, the roller skate having a second bracket disposed around the drive shaft and having a plurality of eyelets capable of releasably receiving the connection pins, upon rotation of the first bracket relative to the second bracket, for attaching the first bracket to the second bracket and the drive element to the drive shaft, the L-shaped housing further comprising a reciprocating locking pin receivable in a hole in the second bracket thereby resisting rotation of the L-shaped housing to the second bracket.

2. A motorized roller-skate according to claim 1 characterized in that said locking pin is secured to a sliding plate for permitting the withdrawal of said pin from the hole of said second bracket and the consequent release of the engagement between said connection pins and said eyelets.

* * * * *